US006193580B1

(12) United States Patent
Albert et al.

(10) Patent No.: US 6,193,580 B1
(45) Date of Patent: Feb. 27, 2001

(54) ACTION DOLL

(75) Inventors: Ross Albert, Oyster Bay; Judy Albert, deceased, late of Oyster Bay, by Arthur Albert, administrator; Joseph Truchsess, Port Chester, all of NY (US)

(73) Assignee: Pragmatic Designs, Inc., Port Chester, NY (US)

( * ) Notice: Subject to any disclaimer, the term of this patent is extended or adjusted under 35 U.S.C. 154(b) by 0 days.

(21) Appl. No.: 09/178,662

(22) Filed: Oct. 26, 1998

(51) Int. Cl.[7] ..... A63H 3/28
(52) U.S. Cl. ..... 446/297; 446/28
(58) Field of Search ..... 446/26, 28, 175, 446/268, 297, 313, 320

(56) References Cited

U.S. PATENT DOCUMENTS

| | | | | |
|---|---|---|---|---|
| 1,927,453 | * | 9/1933 | Hill | 446/297 X |
| 2,334,472 | | 11/1943 | Bleecker . | |
| 3,514,899 | | 6/1970 | Bonanno et al. . | |
| 3,755,960 | | 9/1973 | Tepper et al. . | |
| 3,973,840 | | 8/1976 | Jacobs et al. . | |
| 4,249,338 | | 2/1981 | Wexler . | |
| 4,280,292 | * | 7/1981 | Hills | 446/28 X |
| 4,411,096 | | 10/1983 | Smith . | |
| 4,729,751 | * | 3/1988 | Schiavo et al. | 446/268 |
| 4,809,335 | | 2/1989 | Rumsey . | |
| 4,923,428 | | 5/1990 | Curran | 446/175 |
| 4,979,921 | * | 12/1990 | Cardillo | 446/26 |
| 5,083,965 | * | 1/1992 | Mayem | 446/297 X |
| 5,201,683 | | 4/1993 | Ferri | 446/299 |
| 5,376,038 | | 12/1994 | Arad et al. | 446/297 |
| 5,458,524 | * | 10/1995 | Lucas | 446/297 |
| 5,695,381 | | 12/1997 | Truchsess | 446/297 |

FOREIGN PATENT DOCUMENTS

| | | | | |
|---|---|---|---|---|
| 2610531 | * | 8/1988 | (FR) | 446/320 |

OTHER PUBLICATIONS

Bagamals (tm) backpack, shown on p. G4 of Tuerkes/Beckers 1984 Christmas catalog.*

* cited by examiner

*Primary Examiner*—John A. Ricci

(57) ABSTRACT

The present invention provides a toy doll for the amusement of a subject, that includes a torso, body, ahead and limbs, designed, sized and dimensioned for enabling the doll to be worn on the body of the subject in a position thereon sufficient for engaging in a "piggy back" and/or "horsey" style play. The child may engage the instant doll in such "piggy back" and/or "horse" style play, while in sitting, crawling and upright (or standing) play. The toy doll includes an electronic sound emanating module portions of which can be activated by releasably connecting one limb of the doll to another limb of the doll about the body of the subject. The doll includes a motion sensor including an averaging circuit for enabling substantially continuous sound such as galloping, while the doll is in motion. Optionally, the doll includes a tilt sensor for emanating a "neighing" sound when the longitudinal axis of the doll is tilted relative to the vertical axis.

10 Claims, 3 Drawing Sheets

ACTION DOLL

BACKGROUND OF THE INVENTION

Broadly the present invention relates to a toy for the amusement of a subject. More specifically, the invention relates to a toy doll for the amusement of a child. Still more specifically, the invention relates to a toy doll having elements designed for enabling a child to engage it in "piggy back" and/or "horsey" play.

THE PRIOR ART

Various relevant toy dolls and elements thereof have been proposed by the prior art as exemplified by the following United States Patents which are incorporated herein in their entireties for the purpose to aid in enabling the person of ordinary skill in the art to practice the instant invention.

For instance, U.S. Pat. No. 5,695,381 teaches a toy bear or baby doll that laughs or sings a nursery song when bounded or dandled. A particular area on the rump of the doll is pressure sensitive and produces the given sound when a pressure level is detected in that particular area that is within a range of pressure levels produced when the doll's rump contacts the child's knee in a gentle bounce. Tapping one of the bear's knees selects a respective song and controls the sound generator's mode of operation.

U.S. Pat. No. 5,376,038 relates to talking dolls of the type having internal prerecorded speech mechanisms. More particularly, this invention relates to talking dolls of the type having internal prerecorded speech mechanisms, wherein the doll's educational speech is activated by pressing on certain parts of the doll's body and head region. Still more particularly, this invention relates to talking dolls of the type having internal prerecorded speech mechanisms, wherein the doll's educational speech can be programmed by the user to play phrases in a desired sequence. Still more particularly, this invention relates to talking dolls of the type having internal prerecorded speech mechanisms, wherein the doll's educational speech is programmed to advance with the child user and to educate the child user as to the names and functions of the different body parts.

U.S. Pat. No. 5,201,683 teaches a doll that incorporates a mechanism and electric circuit that, originating from a general activation motor which moves a series of engagements, brings about a correlative series of movements which cause the doll to crawl and give out a message and, subsequently, to stop crawling and raise the trunk of its body and head, to turn its head and give out a new message. These movements are based on the eccentric operating several elements related to the arms, legs and head. Likewise, the emission of the messages is based on parts which are independent but combined electrically and mechanically with the general mechanism in order that, altogether, they achieve a succession of movements which are repeated constantly until a general switch is activated by means of, for example, a dummy, or by means of a ball switch activated automatically when the doll is picked up and put upright.

U.S. Pat. No. 4,923,428 discloses an interactive, articulated talking toy that talks and moves certain of its body parts (eyes, mouth, head and arms) in correspondence to microprocessor control that is based upon program material selected from a tape storage device incorporated in the body of the toy. The material selected is determined by a human's response to questions asked by the toy. The material stored on tape contains both audio and data. The processor chooses a particular one of a possible three audio tracks stored on the tape on the basis of the specific response or non-response made by a human. The data track provides data to the processor which causes it to control the toy's body parts in concert with the audio program being reproduced. The toy has limited work recognition capabilities. The result is the appearance of interaction between the toy and a human by the toy's movement of its body parts and its speech seeming to respond to the human's input.

U.S. Pat. No. 4,809,335 teaches a speech unit for producing preselected words or phrases based on the orientation of a toy doll or figure. A gravity sensing means produces an output corresponding to the orientation of the sensing means with respect to gravity. The output of the sensing means is coupled to a speech synthesizer which produces an output based on transitions from one orientation of the sensing means to a second orientation. A timing circuit coupled to the sensing means establishes a time period during which the sensing means must maintain its orientation for an output to be realized. The timing means also is used to shut off power to the speech synthesizer and speaker means to conserve power of the circuit. In an alternate embodiment, the absolute position of the sensing means is used to select a speech output.

U.S. Pat. No. 4,411,096 relates to a toy in the form of a doll or statue representing a human figure. The toy includes a body and a head which is completely separable from the body. The head is contoured and balanced in such a way that when displaced downwardly from its normal at rest position atop the body, it rolls back upwardly to its normal position, seemingly in defiance of gravity. The movement of the head toward its normal position is accomplished by one or more weights embedded in the head, which provide the necessary torque to cause it to move upwardly to its position on the shoulders.

U.S. Pat. No. 4,249,338 teaches a doll that includes a crying sound generator within the dolly body, a first switch for actuating the crying sound generator, at least two additional switches, and an automatic selection arrangement for determining which of the additional switches is connected to stop the crying. The additional switch may be operated by manipulating the doll, e.g., by giving it a bottle, by changing its diaper, or by picking it up and patting its back. In a play sequence the child actuates the switch to produce crying sounds and then attempts to stop the crying by handling the doll in one of the ways stated. When the child hits upon the type of handling which operates the particular additional switch selected by the random selector, the crying sounds stop. A short sequence of sighing or cooing sounds may be used at the end of the crying sounds.

U.S. Pat. No. 3,973,840 discloses a mannequin that includes a head part and a torso part adjustably joined together. In the torso part a sound moving picture projector is mounted to project facial images on a film in a light beam upwardly through the neck in to the head as the film is moved through the projector. Simultaneously sound from a track on the film is picked up, amplified and audibly reproduced. The sound and facial images are correlated to simulate a speaking person. The head part has a face piece with well defined forehead, nose, cheeks and chin but only smooth areas for eyes and mouth which is molded of transparent plastic and surface coated as a rear projection screen. An arrangement in the head receives the light beam from the projector and transmit onto the rear projection screen so that the projected facial features correspond in location to the facial features on the face piece. An electrical circuit supplies current of proper voltage to a motor to operate the movable parts of the projector, to a lamp to supply the light beam and to an amplifier for the sound reproduction means. The film is preferably endless in a removable cassette that automatically rewinds after it passes through the film gate and sound pick up means. A remote switch may be provided to start the projector and automatic means may stop it at the end of the message.

Otherwise, U.S. Pat. No. 3,755,950 teaches a doll that has a talking mechanism which stores a plurality of spoken expressions that can be initiated by moving on or another of its appendages; U.S. Pat. No. 3,514,899 discloses a doll that includes a talking mechanism, e.g., a motor operated crying and/or appendage-moving mechanism, as well as a circuit for activating the mechanism; and, U.S. Pat. No. 2,334,472 relates to a rocking horse that is designed to carry a doll.

The history of the United States continues to influence us in our everyday lives. No other phase of American history has been more influential on the American public that the history of the our Old West. The American movie industry it has given rise to thousands of "westerns," that have influenced the play of generations of American children. It is great part from this influence that "piggy back" and/or "horsey" children's play evolved.

Thus, it would be of great advantage and joy to a child to have a doll with which to engage in the play of "piggy back" or "horsey."

SUMMARY OF THE INVENTION

The instant invention in large part solves the problems of the prior and addresses a long felt need by providing a novel toy.

The instant invention provides a novel toy doll with which a young child can engage in traditional child's play.

It is therefore an object of the instant invention to provide a new and improved toy which has all of the advantages of the prior art and none of its disadvantages.

It is another object of the instant invention to provide a new and improved toy which may be easily and efficiently manufactured and marketed.

It is another object of the instant invention to provide a new and improved toy which is a durable and reliable construction.

It is another object of the instant invention to provide a new and improved toy which can be manufactured at low cost with regard to both labor and materials, and which accordingly can be sold at a low cost as compared to prior art toys, thus promoting commerce.

It is a further object of the instant invention to provide a new and improved toy doll which provides at least some of the advantages of the prior art schemes, while simultaneously eliminating at least some of the disadvantages of them.

It is a further object of the instant invention to provide a new and improved, entertaining toy doll having at least two stretchable, detachably connectable limbs designed to enable the toy doll to be worn on the shoulders or back of a child in "piggy back" or "horsey" or "on-one-knee" style.

It is a further object of the instant invention to provide a new and improved, entertaining, sound emanating, toy doll intended to be worn on the shoulders or back of a child in "piggy back" or "horsey" or "on-one-knee" style.

It is a further object of the instant invention to provide a new and improved toy doll with which a young child can engage in the "piggy back" or "horsey" play in a same or similar manner as real children often ride upon an adult's back or shoulders when playing "piggy back" or "horsey," and, which will produce sounds appropriate to such play in a semi-automatic manner.

It is yet another object of the invention to provide a new and improved toy doll which may be position on the back of the child. The ends of the legs of the doll may then be detachably connected around the waste of the child. The left arm of the doll may then be draped over the left shoulder of the child, and, the right arm of the doll may then be draped over the right shoulder of the child. The child then may grasp the respective hands of the doll and thereafter engage the doll in "horsey" or "piggy back" in upright or standing play.

Optionally, it is a further object of the invention to provide a toy doll that can be engaged by a child from a sitting position. The ends of the legs of the doll may be releasably attached around a thigh or ankle of the child. The child then grasps the ends of the arms of the doll and engage it in "horsey" or "piggy back" play.

Optionally further, it is an object of the invention to provide a doll which a child may engage in "horsey" or "piggy back" play, while in crawling position.

It is an object of the invention to provide further optional modes of operation of the toy doll of the invention that include: (a) positioning the doll on the back of the child; and releasably connecting one arm of the doll with the opposite leg of the doll so that the arm of the doll passes over one shoulder of the child and the leg passes under the opposite shoulder.

In like manner, it is an object of the invention to provide a mode of operation that contemplates releasable attachment between respective arms and legs of the doll.

It is yet another object of the invention to provide a less preferred mode of play that contemplates all of the limitations of the foregoing less preferred modes, except that the body of the doll is positioned over the breast of the child.

Other objects, features, and advantages of the instant invention, in its details of construction and arrangement of parts, will be seen from the above, from the following description of the preferred embodiments when considered in light of the drawings and the appended claims.

DETAILED DESCRIPTION OF THE INVENTION

Figure 1:
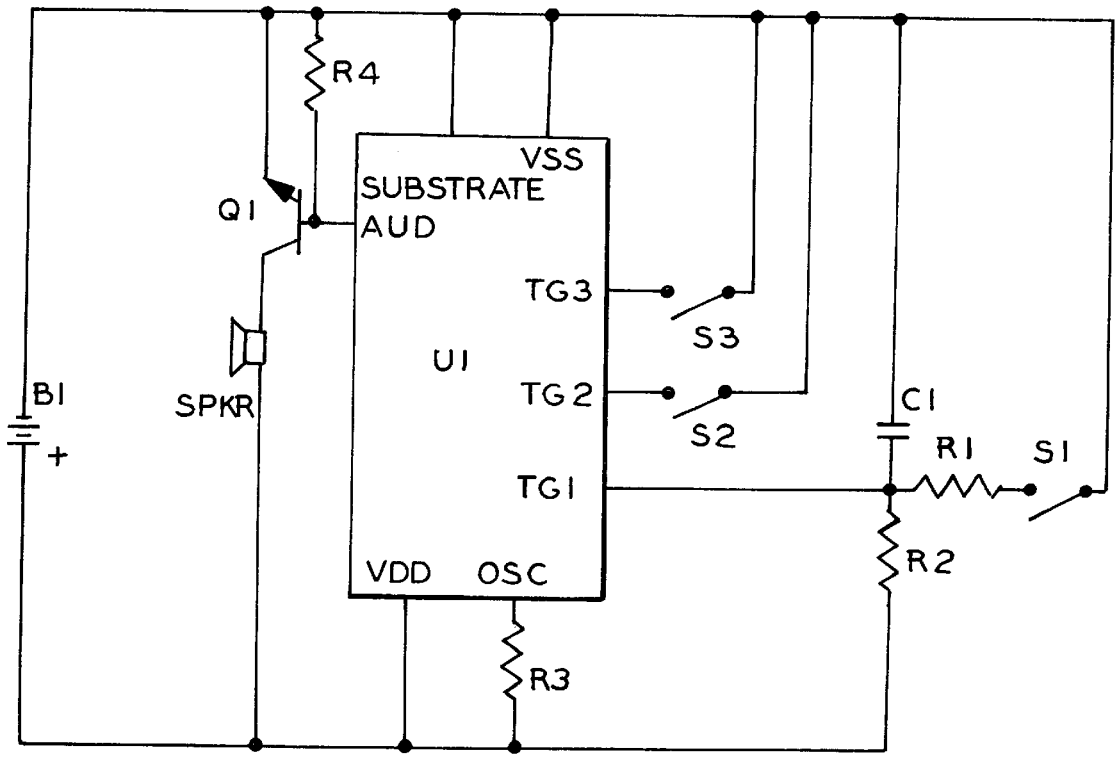
FIG. 1 shows an electronic schematic of a preferred embodiment of the sound producing module of the instant invention.

The present invention relates to a doll for attaching to the back or shoulders of a child for "horsey" or "piggy-back" play. When used, the doll will magically emit galloping or and/or neighing sounds. Referring particularly to FIG. 1; integrated circuit U1 is a typical, commonly available "voice IC" having the capacity to playback stored digitized sounds subject to the control of a software program. The circuitry particularly depicted in support of this function, are oscillator R3, bias resistor R4, amplified Q1, loudspeaker SPKR, and battery B1. This circuitry is well known in the prior art and is incorporated into the instant invention as an old element making up part of a novel combination. Circuit U1 also embodies a number of trigger inputs: TG1, TG2, and TG3. The circuit can thereby be configured to recognize logic states and/or transitions at these inputs and accordingly execute various other diverse software routines. In the depicted most preferred embodiment S1 is a motion sensor for detecting the "bouncing" motion of a child acting out the part of a horse. However, to further facilitate "horsey" play, it would also be desirable to provide continuous playback of galloping sound effects as long as motion is detected. Thus, the preferred embodiment of the invention includes an averaging circuit comprised of R1, R2 and C1 inserted between S1 and the TG1 of U1. The averaging portion of the circuit is designed to provide continuous activation of at least a portion of the circuit U1, despite interruptions caused by the brief pulses generated by the motion sensor S1. By providing this averaging portion in the preferred embodiment, the comparatively brief pulses generated by the motion sensor S1 are averaged to a substantial level of steady-state at TG1, characteristic of motion input from the child engaged in "horsey" play. Thus, the circuit U2 is enabled to produce substantially continuous sound until such motion ceases. Switches S2 and S3 are the tilt sensor and limb connectors, respectively. Closure of switch S1 when the child "rears back" is preferably designed to generate a software interrupt triggering a "neighing" sound. The circuit U1 is preferably programmed to disregard signals from trigger inputs TG1 and TG2 unless at least two of the limbs of the doll are connected together and switch S3 is closed. In this mode, activation of the circuit U1 is precluded during those times when the child is not engaging the doll in "horsey" play. In the most preferred embodiment of the invention, only the legs of the doll are provided with connectors. In the preferred embodiment of the invention, the legs are preferably formed at least in part, of a stretchable elastomeric polymeric material such as a synthetic rubber, or the like. Typical of these type of polymers are: hydrogenated polybutadiene, polyisobutylene and copolymers thereof such as butyl rubber, ethylene-propylene rubber, (EPM), a copolymer of ethylene-vinyl acetate, a copolymer of ethylene-ethylacrylate, EPDM (ethylene-propylene-diene monomer), a hydrogenated triblock copolymer of styrene-butadiene-styrene, and the like.

In an alternative embodiment, the arms of the doll are formed of a stretchable material. In yet another alternative embodiment, the legs and the arms of the doll are formed of a stretchable material. The connectors include electrically conductive contacting portions so as to enable closure of switch S3 complete that portion of the circuit. The connectors embody an conventional type such as a male/female snap members, a male/female interlocking (a.k.a., hook and loop) members such as Velcro®, a button/eye arrangement, and the like. Preferably the connector members are attached to only to the ends of the legs of the instant doll. Optionally the connector members may be fixed to ends of the arms of the doll as well. The child then grasps the respective hands of the doll, each over a respective shoulder of the child; and, proceeds to engage in "horsey" play. Alternatively, while in a sitting position, the child may grasp the hands of the doll while the doll is positioned on the knee or foot of the child.

Figure 2:
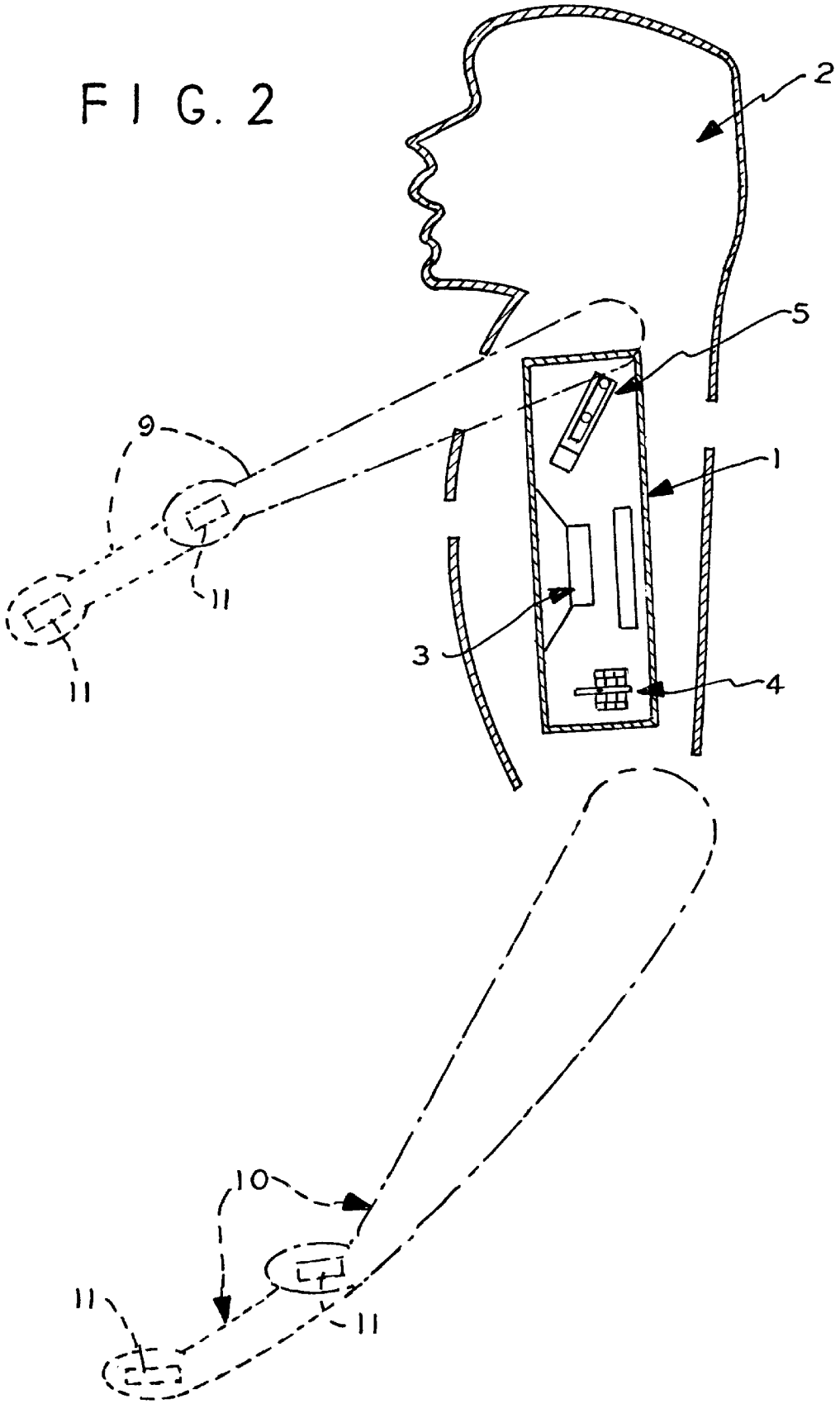
FIG. 2 shows a cutaway partial side elevation view of a preferred embodiment of the doll of the instant invention in a substantially vertical orientation.

FIG. 2 shows a cutaway partial side elevation view of a preferred embodiment of the doll of the instant invention in a substantially vertical orientation. Specifically depicted is the housing 1 contained within the upper torso of the doll 2 of the instant invention. This housing 1 contains the electronic sound module schematically depicted in FIG. 1. As referenced in foregoing FIG. 1, the sound module includes a loudspeaker (SPKR) 3, batteries (B1) (not specifically depicted), motion sensor (S1) 4, and tilt sensor 5, all disposed within the body of the doll 2 (for the sake of clarity, the batteries and interconnecting wiring are not depicted). For the purpose of illustration only, the motion sensor is preferably of the well known type comprises of a metallic, electrically conductive spring member positioned in proximity of a rigid conductive member. When motion occurs perpendicularly to the free axis of the spring, the spring is thereby caused to flex thereby making electrical contact with the rigid member, thereby in turn completing a portion of the electrical circuit U1. By simply adjusting the mechanical parameters of the assembly, the device can be made more or less sensitive to vertical motion than to horizontal motion, thus providing a reliable indication that a child is bouncing up and down in "horsey" play. As previously noted, the foregoing is merely one of a plethora of types of motion sensors known to the prior art. Thus, these other types of motion sensors of course are suitable for this application without departing from the spirit of the instant invention. Optionally a weighted portion (not depicted) may be added to the lower end of the torso of the doll of the instant invention, so as to lower the center of gravity thereof.

Also illustrated in FIG. 2 are the stretchable, detachably connectable arms 9 shown in long-short dash lines in their normal condition and in short dash lines in their extended, stretched condition. In addition, the stretchable, detachably connectable legs 10 are shown in long-short dash lines in their normal condition and in short dash lines in their extended, stretched condition. Connector means 11, such as Velcro® straps, are illustrated as being secured to the extremities of the arms 9 and legs 10.

Figure 3:
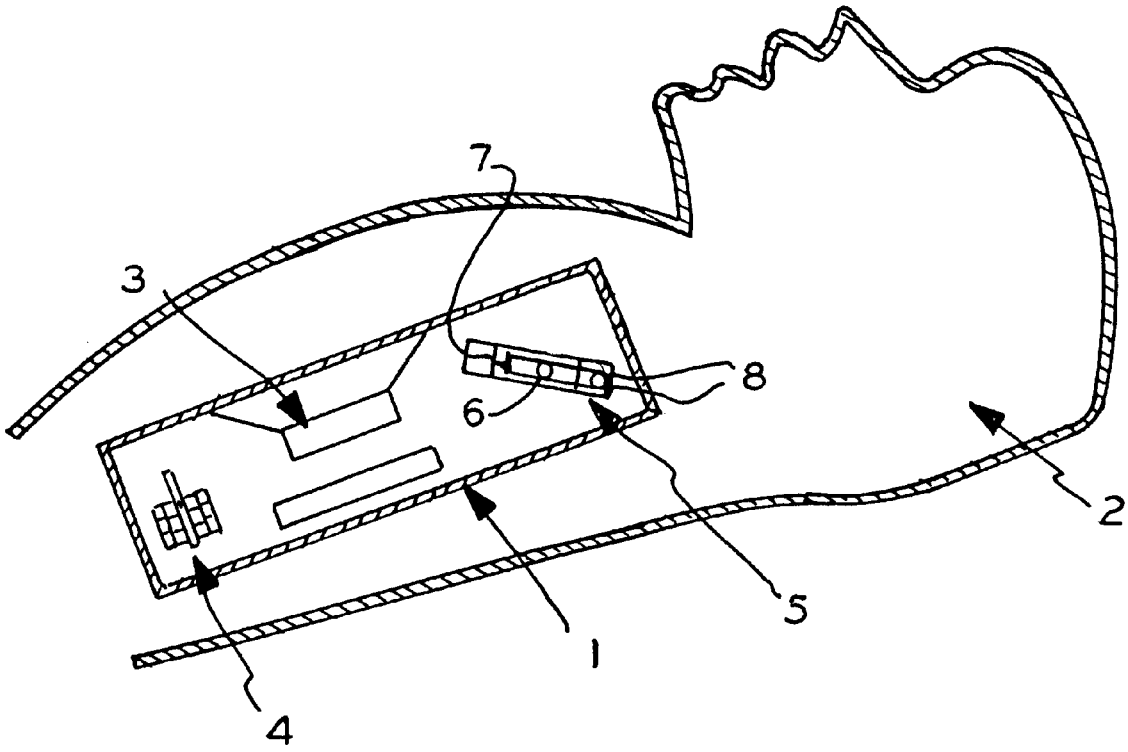
FIG. 3 shows a cutaway partial side elevation view of a preferred embodiment of the doll of the instant invention in an orientation inclined relative to the vertical axis.

FIG. 13 shows a cutaway partial side elevation view of a preferred embodiment of the doll of the instant invention in an orientation inclined relative to the vertical axis. The tilt sensor 5 is typically of the type comprised of a conductive ball 6 that is free to roll in a confined track or tube 7; and, a pair of contacts 8 at one end thereof. When the ball 6 is caused to roll to the end of the track or tube 7 that accommodates the contacts 8, a portion of the circuit U1 is completed across the contacts 8. In this FIG. 3, the child has stood up or "reared back" in the manner of a horse, thereby causing the doll 2, that is detached affixed to the back, knee or shoulders of the child, to become oriented more to the horizontal plane. The ball 6 in the tilt sensor 5 then is caused to roll to the opposite end of the track or tube 7 that accommodates contacts 8; thereby causing that portion of circuit U1 to be completed. Completion of the circuit U1 in this manner triggers a specific sound from the electronics module, such as the neighing or whinnying of a horse. Of course, neighing or whinnying is specific to the preferred embodiment as described above, and is by no means intended to limit the instant invention.

Although not particularly depicted in any of the foregoing FIGURES, optionally, the center of gravity of the doll may be lowered by placing i.e., a sandbag or the like in the seat thereof. A further option for lowering the center of gravity of the doll is effected by locating the battery holders (and hence the batteries) as low as possible relative to the doll when oriented in an upright position. These options operate to maintain the doll in a substantial upright position when it is strapped around the waist or chest of a child engaged in crawling play.

MODES OF OPERATION

As previously herein noted, in the preferred mode of operation the instant action doll is positioned on the back of the child. The ends of the legs of the doll are then detachably connected around the waste of the child. The left arm of the doll is draped over the left shoulder of the child; and, the right arm of the doll is draped over the right shoulder of the child. The child then grasps the respective hands of the doll and thereafter engages the doll in "horsey" or "piggy back" in upright or standing play. Optionally, from a sitting position, the ends of the legs of the doll may be releasably attached around a thigh or ankle of the child. As, in the case above, the child then grasps the ends of the arms of the doll and engages it in "horsey" or "piggy back" play. As indicated above, use of the doll in crawling play is also contemplated by the invention.

Less preferred modes of operation include: (a) positioning the doll on the back of the child; and releasably connecting one arm of the doll with the opposite leg of the doll so that the arm of the doll passes over one shoulder of the child and the leg passes under the opposite shoulder. In like manner, the invention also contemplates releasable attachment between respective arms and legs of the doll. A still less preferred mode of play contemplates all of the limitations of the foregoing less preferred modes, except that the body of the doll is positioned over the breast of the child.

As noted above, through the action of the averaging circuit, while the child is engaged in a "bounding" motion (as in acting out the part of a horse), continuous playback of galloping sound effects may be caused to emanate from the doll so long as such motion is detected. The comparatively brief pulses characteristic of motion input from the child engaged in "horsey" play are averaged to a substantial level of steady-state. Thus, substantially continuous sound emanates until such motion ceases. When the child "rears back" & "neighing" sound is generated. During those times when the child is not engaging the doll in "horsey" play and none of the limbs of the doll are connected, no sound is generated.

The foregoing modes are merely exemplary, and are in no way intended to limit the invention.

The terms "piggy back" and/or "horsey", as used herein, relates to any and/or all manners which enables a subject to affix a toy to their neck and/or back and/or shoulders and/or knee during play to emulate the manner in which an adult carries a child in "piggy back" and/or "horsey" fashion.

Although the invention has been described with reference to certain preferred embodiments, it will be appreciated that many variations and modifications may be made within the scope of the broad principles of the invention. Hence, it is intended that the preferred embodiments and all of such variations and modifications be included within the scope and spirit of the invention, as defined by the following claims.

We claim:

1. A doll for the amusement of a child comprising:

detachably connectable limbs;

an electronic sound emanating module having a tilt motion sensor which is activated when the position of said doll changes from a substantially vertical position toward a horizontal position, said limbs and said module being designed to enable a child to engage in "horsey" or "piggy-back" style play with said doll; and, a circuit means for providing playback of sound when motion of said doll is detected through said motion sensor.

2. The doll of claim 1, wherein said detachably connectable limbs include a stretchable material.

3. The doll of claim 2 wherein said detachably connectable limbs further include detachable connectors at the extremities thereof.

4. The doll of claim 1 wherein said motion sensor includes detecting a bouncing motion of said doll.

5. The doll of claim 1 which includes means for continuous activation of at least a portion of said circuit means despite interruptions caused by brief pulses detected by said motion sensor.

6. The doll of claim 5 which includes a switch means having electrically conductible contacts fixed to the extremities of said limbs which are actuable when said limbs are placed into contact with one another.

7. The doll of claim 1, wherein the sound is a galloping sound.

8. The doll of claim 1, wherein the sound is a neighing sound.

9. A doll for the amusement of a child, said doll having a circuit in an electronic sound module and comprising:

a tilt motion sensor for detecting the motion of said doll and activating a sound when said child "rears back" in "horsey" or "piggy-back" play with said doll; and circuit means providing continuous playback of said sound as long as motion is detected in said doll through said motion sensor, said motion sensor activating said circuit means.

10. The doll of claim 9 wherein the sound is a galloping sound or a neighing sound.

* * * * *

UNITED STATES PATENT AND TRADEMARK OFFICE

CERTIFICATE OF CORRECTION

PATENT NO. : 6,193,580 B1 
DATED : February 27, 2001
INVENTOR(S) : Ross Albert, Judy Albert and Joseph Truchsess It is certified that error appears in the above-identified patent and that said Letters Patent is hereby corrected as shown below:

Title page,
Item [73], Assignee should appear as follows:

Assignee: The Alberts Design Company, Inc., Oyster Bay NY
Pragmatic Designs, Inc., Port Chester, NY Attorney, Agent or Firm should appear as follows:
*Attorney, Agent, or Firm*– Stephen E. Feldman Signed and Sealed this Eleventh Day of June, 2002

*Attest:*

JAMES E. ROGAN
*Director of the United States Patent and Trademark Office*

*Attesting Officer*